US007249999B2

(12) United States Patent
Malcolm et al.

(10) Patent No.: US 7,249,999 B2
(45) Date of Patent: Jul. 31, 2007

(54) COIN HANDLER

(75) Inventors: Reginald Hallas Bell Malcolm, Leeds (GB); Anthony Edward Morrison, Rochdale (GB); Paul Richard Ashford, Bury (GB); Ian Macleod, Wigan (GB)

(73) Assignee: Coin Controls Limited (GB)

( * ) Notice: Subject to any disclaimer, the term of this patent is extended or adjusted under 35 U.S.C. 154(b) by 70 days.

(21) Appl. No.: 10/496,436

(22) PCT Filed: Nov. 18, 2002

(86) PCT No.: PCT/GB02/05197

§ 371 (c)(1),
(2), (4) Date: Nov. 3, 2004

(87) PCT Pub. No.: WO03/046844

PCT Pub. Date: Jun. 5, 2003

(65) Prior Publication Data

US 2005/0107025 A1 May 19, 2005

(30) Foreign Application Priority Data

Nov. 20, 2001 (GB) ..... 0127731.8

(51) Int. Cl.
*G07D 1/00* (2006.01)

(52) U.S. Cl. ..... 453/49

(58) Field of Classification Search ..... 453/18, 453/39, 49, 57

See application file for complete search history.

(56) References Cited

U.S. PATENT DOCUMENTS

| | | | | |
|---|---|---|---|---|
| 2,848,158 | A * | 8/1958 | Miller | 235/32 |
| 3,998,237 | A * | 12/1976 | Kressin et al. | 453/6 |
| 4,360,034 | A * | 11/1982 | Davila et al. | 453/8 |
| 4,836,825 | A * | 6/1989 | Smeets et al. | 453/49 |
| 5,684,597 | A * | 11/1997 | Hossfield et al. | 356/635 |

FOREIGN PATENT DOCUMENTS

| | | |
|---|---|---|
| EP | 0 496 588 | 7/1992 |
| EP | 0.496.588 A1 * | 7/1992 |
| EP | 0 526 421 | 2/1993 |

* cited by examiner

*Primary Examiner*—Patrick Mackey
*Assistant Examiner*—Mark J. Beauchaine
(74) *Attorney, Agent, or Firm*—Michael Best & Friedrich LLP

(57) ABSTRACT

There is provided a coin handling apparatus which can be employed in public telephones and other coin fed apparatus. In a preferred embodiment the coin handling apparatus comprises a pocketed disc (100) arranged, in use, to cooperate with an entry portal (506) for receiveing coins and an exit portal (507) for dispensing coins, and drive means arranged, in use, to cause rotation of the pocketed disc (100), said drive means comprising a driving gear (200) and a driven gear (120) wherein the pocketed disc (100) comprises said driven gear (120), and the driving gear (200) is arranged such that it rotates the disc (100) in predetermined increments and rotation of the pocketed disc (100) can be paused between each incremental rotation.

22 Claims, 8 Drawing Sheets

COIN HANDLER

The invention relates to handling apparatus and more particularly, but not exclusively, to a coin handling apparatus for use in public telephones and other coin fed apparatus.

It is known to provide coin operated telephones with a coin handling mechanism which receives and retains coins until a call is either successfully or unsuccessfully connected or completed. Upon successful connection the coins are released into a money box by the handling mechanism. If the call is not successfully connected the coins are returned to the customer. Such mechanisms are referred to as escrow devices.

Whilst escrow devices are well known in the coin handling art they are often complex, making them both expensive and prone to failure. Furthermore, the large number of coins in use in different countries and the variation in size of said coins means that existing escrow devices are often unsuitable for global use without adaptation.

Coin handling apparatus suitable for employment in such devices must be both compact and capable of operating with a low power demand.

One of the most commonly available prior art coin handling mechanisms utilises a helical coil within a tube. Once a coin is received by the coil, the coil rotates thus producing a screw action which advances the coin forward and allows for receipt of the next coin, and so on. However, this system, whilst being compact, effectively pushes the coins along their edges, thus creating a considerable amount of friction, and an undesirably high power demand.

An alternative type of coin handling device employs a disc having a plurality of pockets. A coin is received by a first pocket and the disc then rotates to present the next pocket for receipt of a coin and so on. Whilst such devices overcome some of the disadvantages associated with a screw type coin handling device, conventional disc devices have their own inherent difficulties. They require a large number of components which increase both cost and bulk. In addition the pockets require accurate positioning to facilitate receipt of a coin. This is difficult to achieve and has necessitated the employment of precisely manufactured gears and highly controllable motors to drive the disc.

It is an improvement in this second type of coin handling apparatus, suitable for use in escrow devices, to which the present invention relates. Accordingly it is an aim of the present invention to overcome at least one of the disadvantages associated with prior art coin handling devices whether referred to herein or otherwise.

According to one aspect of the present invention there is provided a coin handling apparatus comprising a pocketed disc arranged, in use, to cooperate with an entry portal for receiving coins and an exit portal for dispensing coins, and drive means arranged, in use, to cause rotation of the pocketed disc, said drive means comprising a driving gear and a driven gear wherein the pocketed disc comprises said driven gear, and the driving gear is arranged such that it rotates the disc in predetermined increments and rotation of the pocketed disc can be paused between each incremental rotation.

Preferably, rotation of the pocketed disc can be stopped while it is in a paused state such that a pocket of the disc is held in alignment with the entry portal.

According to a second aspect of the invention, there is provided coin handling apparatus comprising a pocketed disc arranged, in use, to cooperate with an entry portal for receiving coins and an exit portal for dispensing coins, and drive means arranged, in use, to cause rotation of the pocketed disc, said drive means comprising a driving gear and a driven gear wherein the pocketed disc comprises said driven gear and the driving gear has a driving element, arranged to engage corresponding drive receiving elements of the driven gear arranged to engage corresponding drive receiving elements of the driven gear and to cause rotation of the pocketed disc, and a parking element, arranged to engage corresponding parking element receptacles of the driven gear to allow movement of the driving gear whilst preventing movement of the driven gear and thus of the pocketed disc, such that a pocket of the disc can be accurately located in line with the entry portal after rotation of the pocketed disc.

Preferably, any imprecisions and time delays in the control of the driving gear may thus be accommodated.

Preferably, the driving gear can be stopped when the parking element is engaged with a parking element receptacle of the driven gear in order to hold the pocketed disc stationery when a pocket of the disc is aligned with the entry portal.

Preferably, the pocketed disc comprises between 5 and 15 pockets, more preferably between 8 and 10 pockets, for example 9 pockets.

Preferably, the driven gear of the pocketed disc comprises between 1 and 6 drive receiving elements, for each pocket, more preferably between 2 and 4 drive receiving elements, for example 3 drive receiving elements for each pocket.

Preferably, a parking element receptacle is interposed between all adjacent drive receiving elements.

Preferably, a parking element receptacle lies on the dividing line between all adjacent pockets. More preferably, the centre of a parking element receptacle lies on the dividing line between all adjacent pockets.

Preferably, each pocket can accommodate one coin.

Preferably, the coin handling apparatus further comprises a casing. Preferably, the casing comprises two sections.

Preferably, the casing comprises integral mountings for all major components of the coin handling mechanism.

Preferably, one of said casing sections may provide mountings for the pocketed disc, drive gear, a motor and an exit gate.

Preferably, the pocketed disc comprises a base having a driven gear formed on a first side thereof and a plurality of pockets formed on the second side thereof and which have openings orientated towards the edge of said base.

Preferably, the pocketed disc is pivoted about its centre and arranged for rotation. Preferably, the pocketed disc comprises an aperture in the centre thereof about which it may be pivoted. The pocketed disc may be mounted to a pivot, formed in the casing, by said aperture.

Preferably, in use, the pocketed disc is orientated such that its axis of rotation lies at substantially 90° to the vertical.

Preferably, the driven gear comprises a gear ring.

Preferably, the driven gear may be formed such that the drive receiving elements and parking element receptacles are orientated towards the axis of rotation of the disc.

Preferably, the gear ring lies adjacent to the peripheral edge of the pocketed disc.

Preferably, the drive means comprises a geneva mechanism, more preferably an internal geneva mechanism. An internal geneva mechanism may advantageously create the greatest mechanical advantage when it is required. Conversely an external geneva mechanism may not have the greatest mechanical advantage when desired and may thus not have the optimum efficiency. An internal geneva mechanism may also avoid the creation of excessive forces at undesirable points during its operation and thus reduce the rate of component ware.

Preferably, the driving gear comprises a pin which acts as the driving element and a segment, removed from the pin, which acts as the parking element.

Preferably the segment of the driving gear is separated from the pin in the radial direction by a sufficient extent to allow clearance for the innermost regions of the driven gear such that the pocketed disc may be able to rotate as the driving gear is rotated.

Preferably, the segment comprises a semi-circle lying coaxially to the axis of rotation of the driving gear.

Preferably, the arcuate face of the segment is arranged, in use, to cooperate with the parking element receptacle.

Preferably, the peg is a slightly distorted cylinder. It may be kidney shaped in cross section. Preferably at least part of the peg lies further from the axis of rotation than does the arcuate face of the segment, and may lie substantially behind the segment with its centre tangential to the centre of the arcuate face.

Preferably, the driving gear further comprises a power receiving gear, lying coaxially to the axis of rotation of the driving and parking elements.

The driving gear may comprise a frusto conical member having the power receiving gear forming the peripheral edge at the base thereof and the driving and parking elements located at the opposed end thereof.

Preferably the power receiving gear may be arranged to cooperate either directly or indirectly with a motor. For example the power receiving gear may engage with a gear fixed to an electric motor.

Preferably, the pocketed disc driven gear comprises radially extending slots whose internal faces act as the drive receiving elements. Preferably the driven gear comprises arcuate cavities interposed between the slots which act as the parking element receptacles.

Preferably the slots of the driven gear are tapered such that they are wider at their base than at their open ends.

The depth of the slots may be approximately twice that of the arcuate parking element receptacles.

The elements of the driven gear and drive gear may thus be dimensioned such that, in use, they cooperate effectively with one another. The kidney shaped peg may have a narrow side orientated towards the base of the slot as it first enters it. Upon rotation of the driving gear the peg may move deeper into the slot and turn relative to the slot so that a wider part begins to be orientated towards the slot base. Simultaneously the action of the peg on a side of the slot may cause the driven gear and thus the pocketed disc to rotate about its axis.

Further rotation of the driving gear may move the peg to the base of the slot and rotate it such that its wider face is orientated towards the slot base and at the same time cause the pocketed disc to rotate further. Upon further rotation of the driving gear the peg may move away from the base of the slot and become orientated such that a narrower part faces the slot base once more. The pocketed disc may also be rotated further.

As the peg leaves the slot the parking segment may engage the arcuate parking element receptacle thus preventing rotation of the pocketed disc until the driving gear rotates further and the peg engages the next slot and the parking segment disengages the parking element receptacle.

The shape of the peg and slot may thus allow smoother operation of the coin handling apparatus and reduce undesirable mechanical stresses.

Preferably, the driving gear and driven gear are orientated to rotate in the same plane. Thus in the event of a power or motor failure the pocketed disc may be manually rotated without the risk of damaging the gears or motor.

The driving gear may be arranged such that it may be manually rotated without the need to disassemble the coin handling apparatus. For example the driving gear may be rotated with an allen key which may be inserted through an aperture in the casing.

Preferably, the pockets are formed by a wall extending substantially at right angles to the base and may be open pockets, having no additional wall orientated parallel to the plane of the base to form a side to the pockets opposed to the base of the disc.

Preferably, an internal face of the casing of the coin handling apparatus is arranged, in use, to abut the free edges of the pocket walls and thus form the side of the pockets opposed to the base of the disc. Alternatively, the side walls of the pockets opposed to the base of the disc may be formed by a second disc abutting the walls of the pockets.

Preferably the walls of the pocket have ridged upper edges arranged such that they form a number of radially extending annular ridges and grooves.

Preferably the annular ridges and grooves formed upon the upper edges of the pocket walls are arranged, in use, to cooperate with corresponding annular ridges and grooves formed upon the internal face of the casing of the coin handling apparatus.

The cooperation of the ridges and grooves of the pocket walls and casing may minimise or prevent the risk of coins becoming trapped between the pocket walls and the casing as the pocketed disc is rotated.

The grooved nature of the casing may also reduce friction between coins and the casing as the pocketed disc is rotated and may thus improve the efficiency of the coin handler.

A sensor may be arranged adjacent the entry portal to detect the presence of an empty pocket adjacent to, and in line with, the portal and provide a signal to indicate that the rotation of the pocketed disc should be stopped.

Preferably, the base of the pocketed disc comprises an aperture within each pocket.

Preferably, the sensor may comprise a transmitter and a receiver or detector, preferably a light transmitter and detector. Preferably the sensor is located adjacent to the first side of the pocketed disc and emits a light beam such that it may pass through one of said apertures in the base when said disc is correctly positioned.

Preferably, if the pocket is empty light will not be reflected back to the detector and the disc will not be rotated further.

Preferably, if the pocket contains a coin the light will be reflected back to the detector and the disc will continue to be rotated.

Preferably the first side of the pocketed disc will also reflect light to the detector such that the disc is not caused to stop when one of said apertures is not aligned with the sensor.

Preferably, if the pocket is empty the transmitted light beam will pass through the aperture and hit the inside face of the outer casing and be scattered, such that very little light returns to the detector. This may thus cause the sensor to indicate that an empty pocket is correctly aligned with the entry portal and the disc should be stopped.

Preferably, the internal surface of the casing aligned with the sensor is formed or treated such that it enhances the scattering of light. For example it may have a ridged or crinkled surface.

Preferably each aperture in the base is aligned with the centre of the pocketed disc and a parking element receiver of the driven gear. Thus the pocketed disc may be stationary while the sensor checks to see if the pocket is empty. This may ensure the sensor has adequate time to check the pocket and signal for rotation of the driving gear to be stopped, if the pocket is empty, before it causes the pocketed disc to advance and while the pocketed disc is aligned with the entry portal.

Preferably the exit portal of the coin handling apparatus communicates with two exit paths. Preferably the exit portal is gated and the gate may be positioned so as to block one or other of said exit paths.

Preferably the first of said exit paths communicates with a coin collecting box and the second of said exit paths communicates with a coin return aperture.

Upon successful completion of a transaction, for example a telephone call, the gate may be positioned so as to block the second exit path to allow the coins to exit via the first exit path. Upon unsuccessful completion the first exit path may be blocked and coins guided through the second exit path. In either event the pocketed disc may be caused to advance such that it dispenses said coins.

Preferably the exit gate has two hinge pins by which it is mounted to the casing. Preferably said pins are slightly barrelled. This may allow the exit gate to be mounted without becoming distorted if the mountings of the casing which it is attached to are not properly aligned.

Preferably the coin handling apparatus further comprises a coin detector prior to the entry portal. The coin detector may "vet" the coins to ensure they are legal tender and reject those that are not. Suitable coins may be released and allowed to pass through the entry portal. The coin detector may also provide information relating to the coin type to a controller. Such coin detectors are well known in the art.

The controller may be responsible for receiving instructions from the sensor and the coin detector and for instructing the driven gear. The controller may thus be aware of the value of the coin in each pocket of the pocketed disc. Depending upon the cost of a transaction, upon completion thereof, the controller may thus calculate whether the gate should block the first or second exit path as each pocket comes into alignment with the exit portal. The controller may thus ensure that the cost of the transaction is recovered but that any change is also returned to the user regardless of the order in which the coins were inserted into the apparatus.

The apparatus may be provided with a second sensor in the exit portal to detect the presence of a coin as it exits the pocket of the disc and passes to an exit path. The sensor may be substantially the same as the first sensor hereinbefore described and operate in substantially the same manner. The inner facing of the casing may be shaped to form part of the exit portal and may be textured, as hereinbefore described to cause scattering of the light and prevent it returning to the sensor.

Light may only return to the sensor if a coin lies between it and the casing of the coin handling apparatus such that light is reflected. The sensor may thus signal that rotation of the pocketed disc should be prevented until light is no longer returned to it thus indicating that the coin has cleared the exit portal. The controller may prevent rotation of the disc until it receives the correct signal from the second sensor. Jamming of coins in the exit portal may thus be prevented.

Instead of utilizing a Geneva mechanism, a worm and gear drive mechanism may be provided.

According to another aspect of the invention there is provided a coin handling apparatus comprising a pocketed disc arranged, in use, to cooperate with an entry portal for receiving coins and an exit portal for dispensing coins, the apparatus being provided with an anti-jam mechanism, for example in the form of a current flow sensor which will detect the effect of a jam on a motor and initiate a momentary reversal of the direction of drive, followed by a return to the normal drive. This change of direction may be repeated until the jam clears. Alternatively, the drive reversal may repeat for a predetermined number of attempts whereupon the drive mechanism stops if the jam fails to clear.

According to yet another aspect of the invention, there is provided a coin handling apparatus comprising a pocketed disc arranged, in use, to cooperate with an entry portal for receiving coins and an exit portal for dispensing coins, the apparatus incorporating an energy optimiser arranged to track how many coins or tokens are in the pockets of the disc and then decide which is the most energy efficient direction for the disc to rotate to empty the pockets. For example if the disc is almost full it may be most efficient to keep the disc rotating in one direction, for example the anti-clockwise direction, to drop the coins or tokens either into a cash box, or pay them out to a user. However, if there are less than a predetermined number of coins in the pockets (for example five) the disc may move a lesser distance and hence use less energy, if it rotates in another direction for example clockwise to drop the coins or tokens into the cash box or pay them out.

According to the present invention there is further provided a coin fed device comprising a coin handling apparatus as hereinbefore described.

By way of example, specific embodiments of the invention will now be described, with reference to the accompanying drawings, in which.

Figure 2:
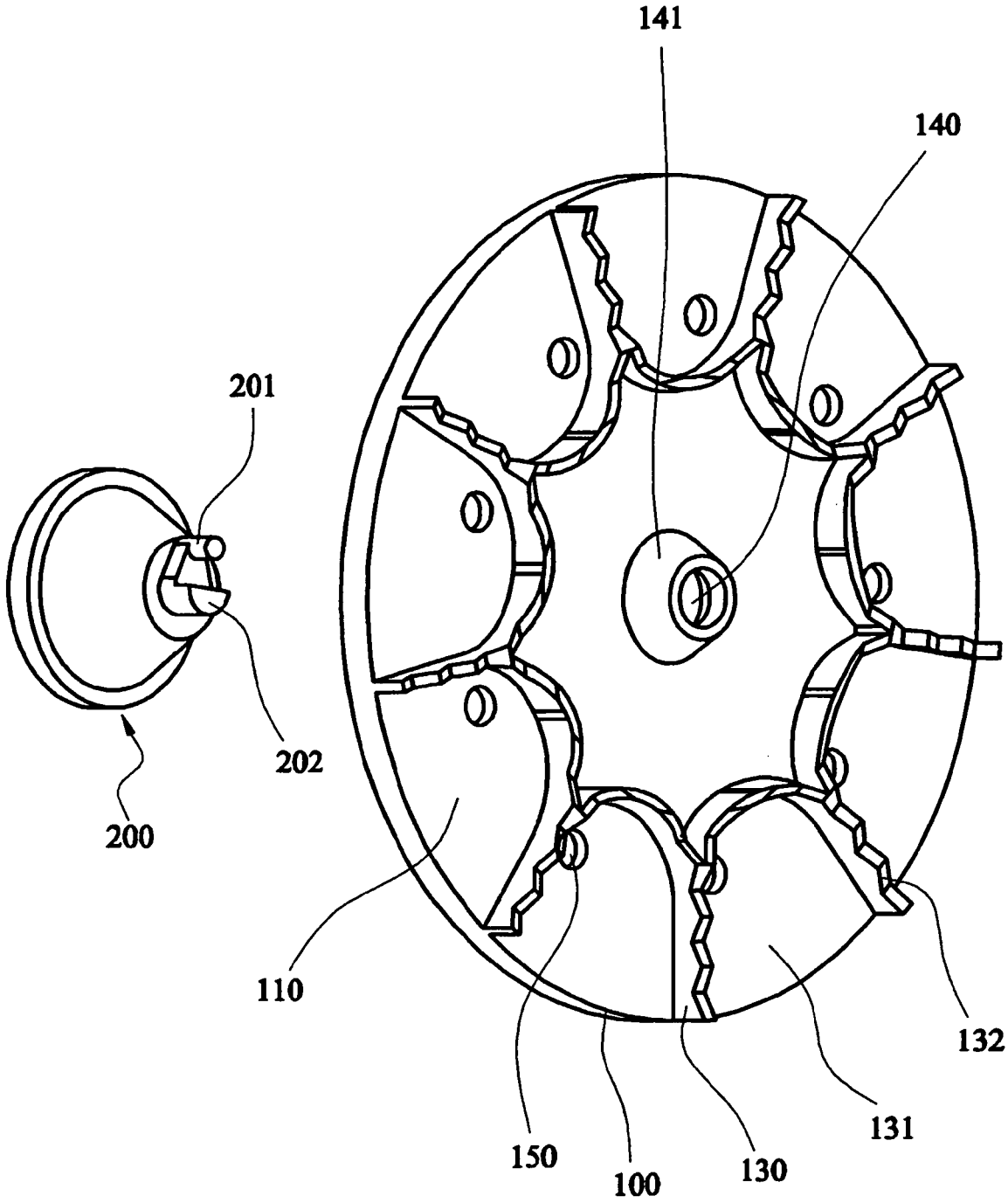
FIG. 2 is a perspective view of the reverse side of the pocketed disc and driven gear to that of FIG. 1.
Figure 8:
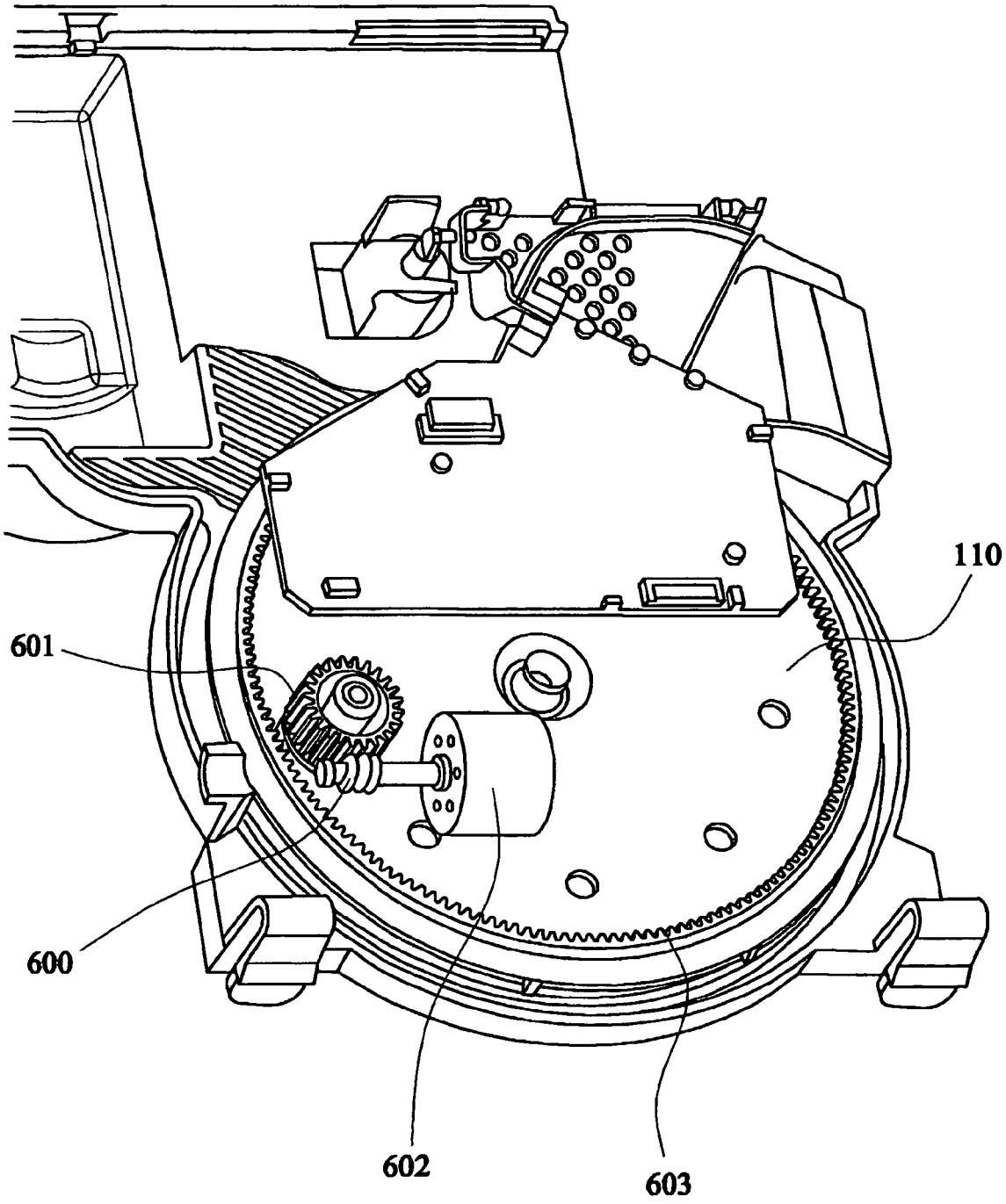

FIGS. *7a* to *7d* are frontal, side and rear views of an exit gate for a coin handling apparatus in accordance with the present invention; and FIG. 8 is a view similar to FIG. 2 but showing an alternative embodiment of the invention.

Figure 1:
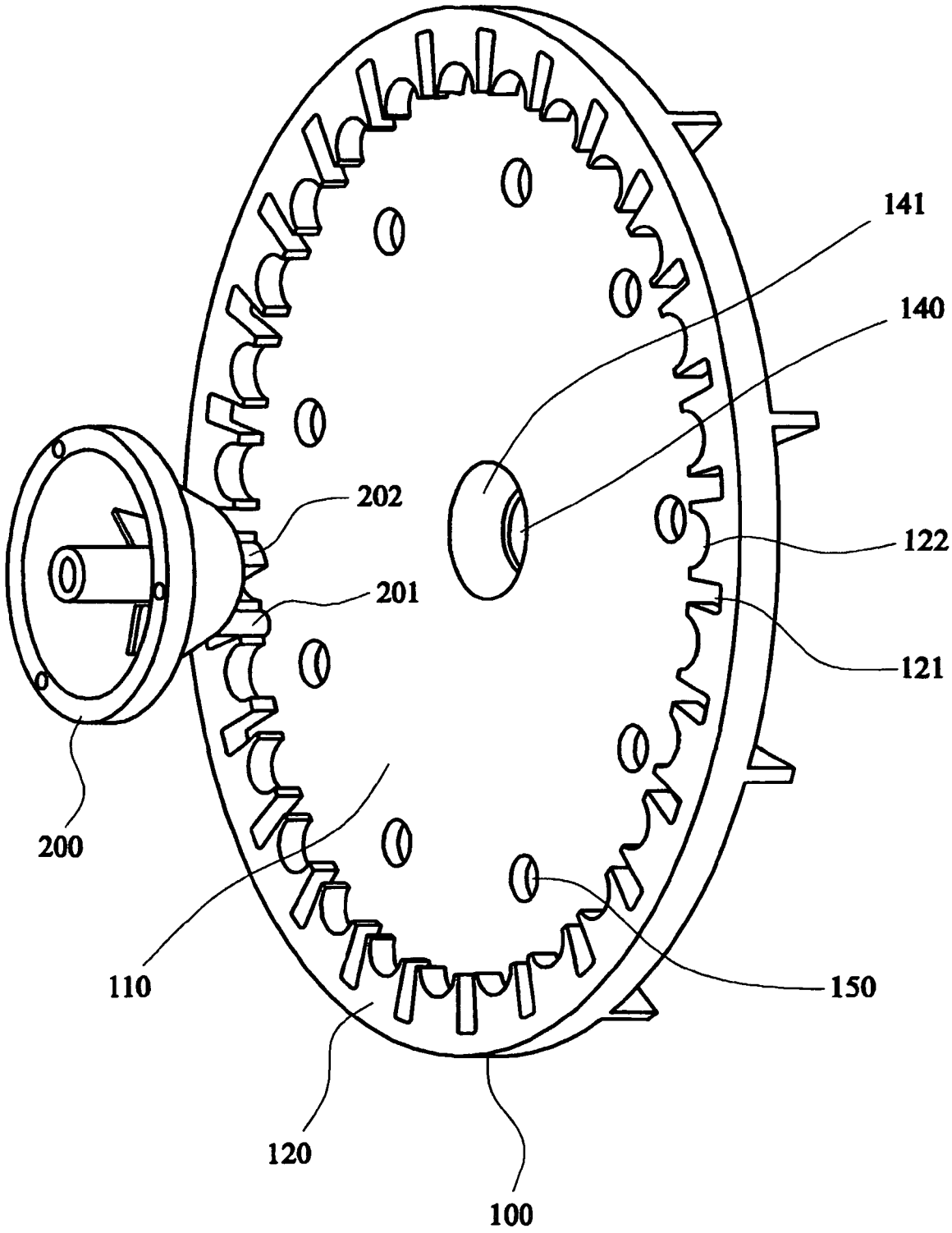
FIG. 1 is a perspective view of the pocketed disc and driven gear of the present invention.
Figure 3:
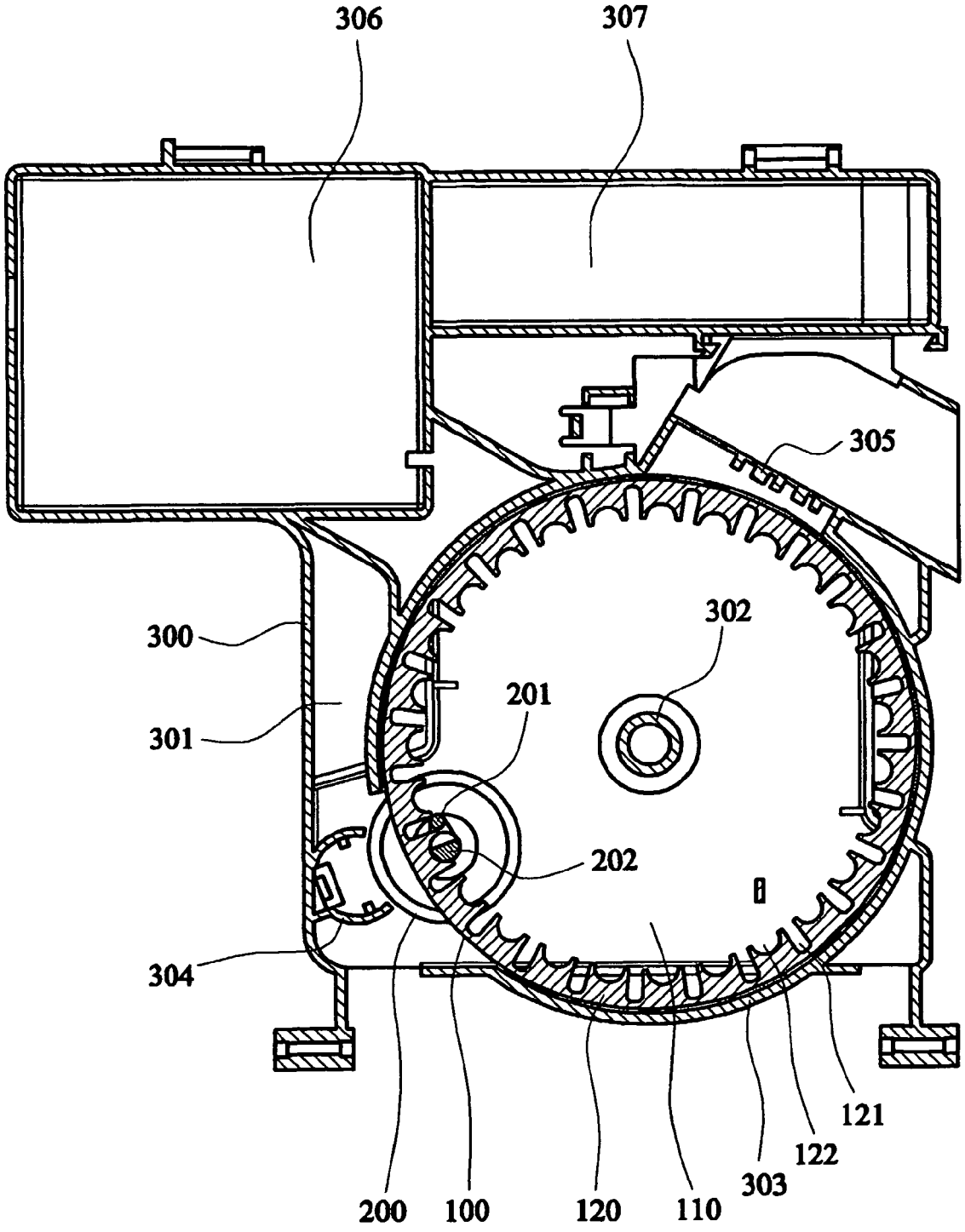
FIG. 3 is a cross-sectional view of the coin handling apparatus of the present invention.

The pocketed disc 100 and driving gear 200 best illustrated by FIGS. 1 and 2 are intended to be inserted into a first section of casing 300 as shown in FIG. 3.

The casing 300 has a substantially flat internal face 301 from which a number of walls extend, shown in hatching. One of said walls is substantially annular and provides a pivot 302 upon which the pocketed disc 100 is mounted. A substantially annular wall 303 is also defined to surround the peripheral edge of the pocketed disc 100 and serves to ensure it is properly maintained in position.

The first casing section 300 also defines a pivot for the driven gear 200 (not shown) and mountings 304, 305 for a motor (not shown) and exit gate 400 respectively. The outer casing also defines cavities 306, 307 to retain a coin detector and control unit (not shown) respectively.

The pocketed disc 100 comprises a substantially planar base 110 from which projects a gear ring 120 from a first side thereof adjacent its peripheral edge. Walls 130 defining pockets 131 project from the second side of the base 110.

The gear ring 120 defines alternate drive receiving slots 121 and parking element receptacles 122. These are arranged in use to engage sequentially with a corresponding driving peg 201 and parking segment 202 on the driving gear 200 respectively.

In use, the slots 121 and receptacles 122 and peg 201 and segment 202 are arranged such that rotation of the driving gear 200 causes rotation of the driven gear 120 and thus the entire pocketed disc 100 when the peg 201 engages one of said slots 121. The segment 202 is arranged to engage the receptacle 122 adjacent to said slot 121 as the peg 201 disengages said slot 121 upon further rotation of the driving gear 100.

The segment 202 engages the receptacle 122 in such a way that allows the driving gear 200 to rotate while the gear ring 120 and hence entire pocketed disc 100 remain stationary.

Figure 4:
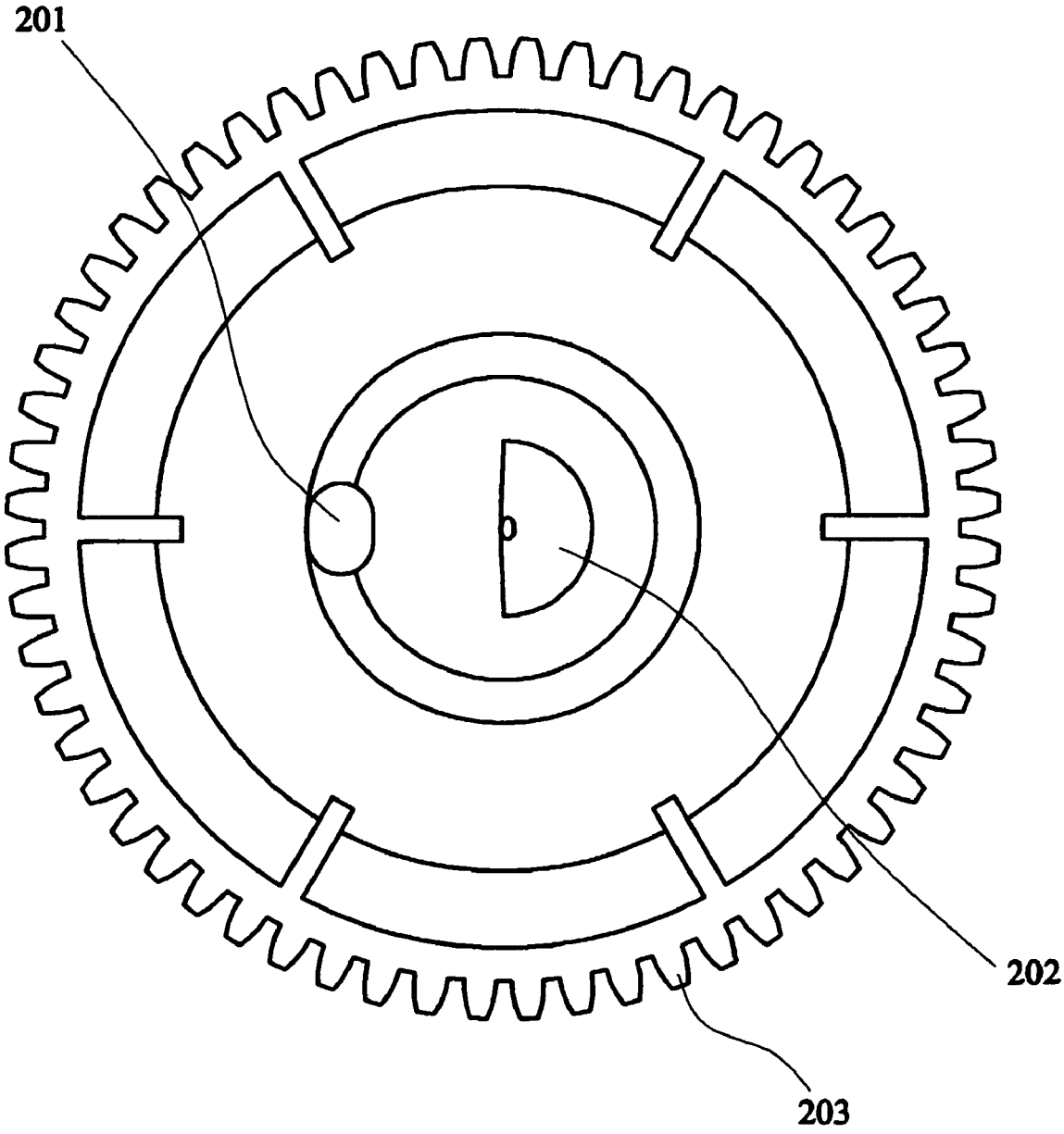
FIG. 4 is an enlarged facial view of the driving gear.
Figure 5:
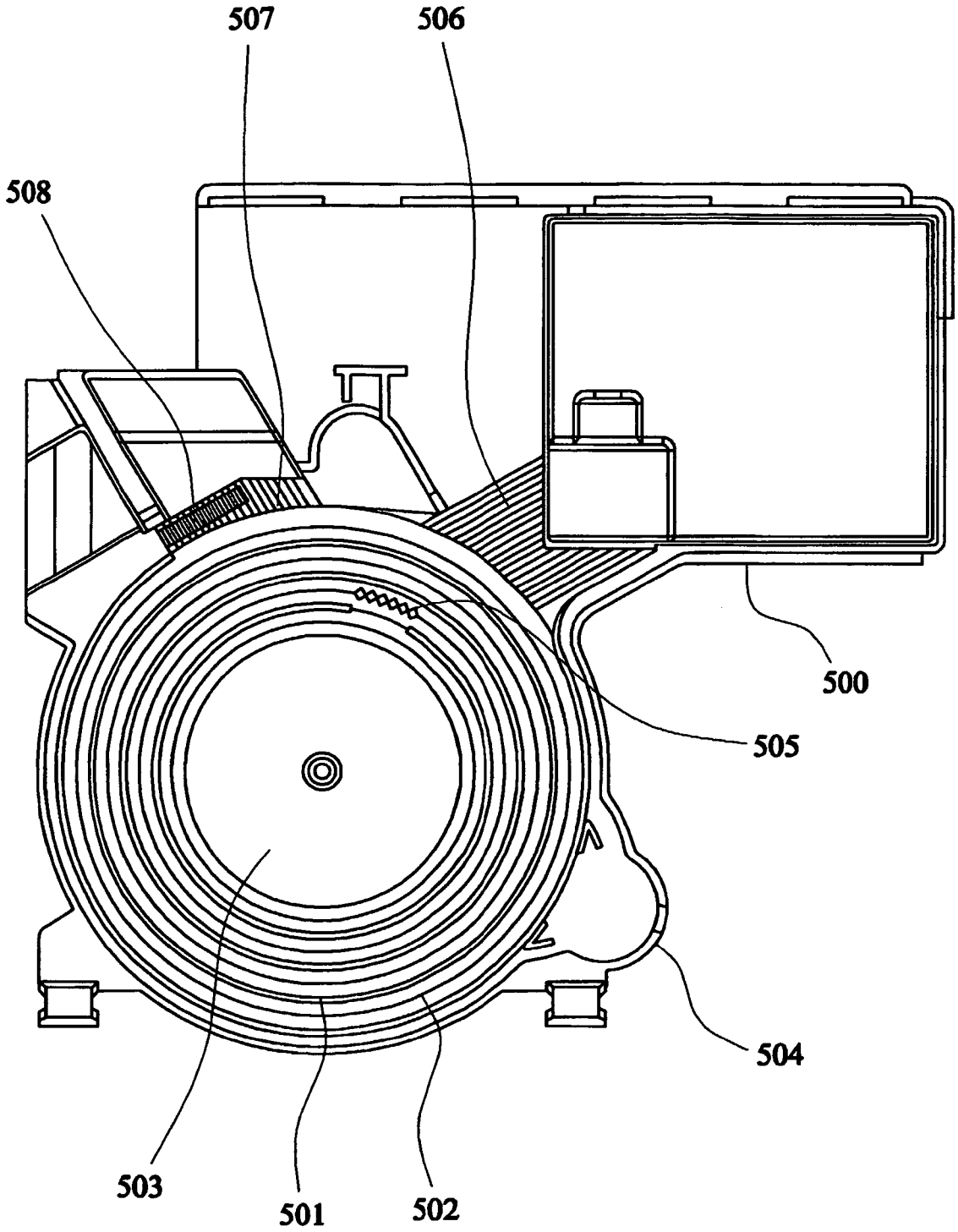
FIG. 5 is a view of part of the casing of the coin handling apparatus of the present invention.
Figure 6:
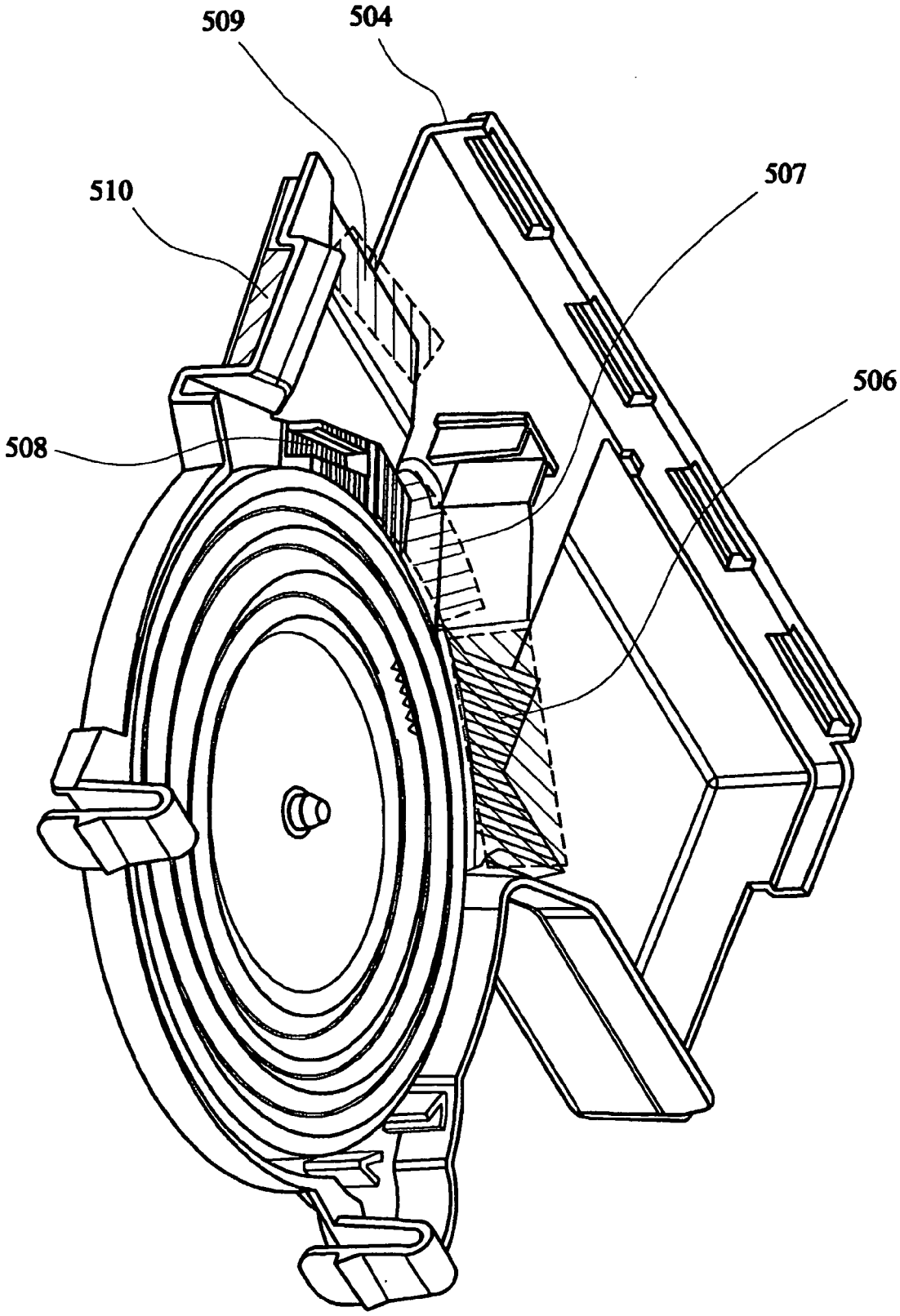
FIG. 6 is a perspective view of the casing of FIG. 5.
Figure 7D:
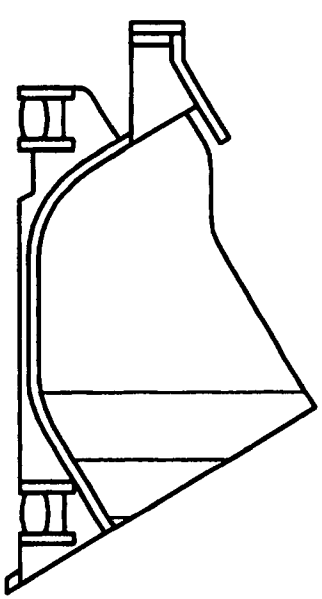
Figure 7C:
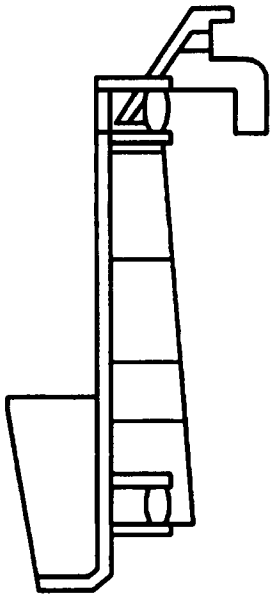
Figure 7B:
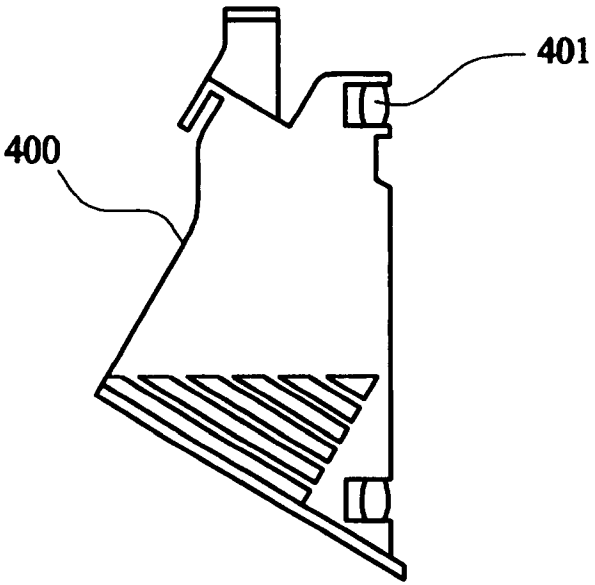
Figure 7A:
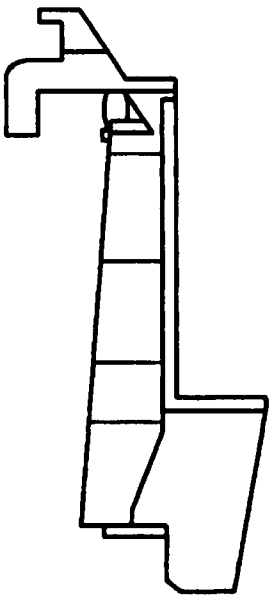

As best shown in FIGS. 2 and 4 the driving gear 200 comprises a frusto conical section having the peg 201 and segment 202 mounted at the narrow end thereof. The opposed end is arranged to secure to a power receiving gear 203 such that it may rotate simultaneously therewith. This gear 203 is arranged to be driven by a further gear cooperating with an electric motor (not shown).

The disc 100 further comprises an aperture 140 defined by a frusto conical section 141 by which it is mounted to the pivot 302.

Apertures 150 are arranged within each pocket 131 of the disc 100 such that they may cooperate with a sensor (not shown).

The walls 130 of the pockets 131 have an undulating or ridged surface 132 such that they may cooperate closely with a second casing section 500 which comprises annular ridges and grooves 501, 502 on its inner base face 503.

The ridges and grooves 501, 502 serve two purposes. Firstly they reduce the risk of coins sliding under the walls 130 of the pockets 131 and jamming the mechanism. In addition they reduce the surface area of the outer casing in contact with coins held in the pockets and thus minimise friction and increase the efficiency of the coin handling mechanism.

The second casing section 500 further comprises walls 504 extending from the base 503 thereof which define features of the coin handling apparatus and the outer walls are arranged in use to abut the outer walls of the first casing section 300 to form a sealed unit. One of said walls is substantially annular and surrounds the peripheral edge of said pocketed disc 100 and serves to ensure it is properly retained in place.

The base 503 further comprises a region having a light scattering surface 505 arranged to lie in line with the apertures 150 of the pocketed disc 100 and a sensor (not shown) on the other side of the pocketed disc 100. A highly ridged surface is particularly suitable for this purpose.

The sensor comprises a transmitter and a detector and transmits a light beam which is reflected back to the detector unless it passes through the aperture 150 and is scattered by the scattering surface 505. If a coin is present in the pocket 131 or the aperture 150 is not aligned with the sensor then the light will be reflected. The sensor and light scattering region 505 are situated adjacent the entry portal 506 such that when the sensor detects an empty pocket 131, i.e. when the transmitted beam is scattered and not returned to the detector, it sends a signal to a controller (not shown).

The sensor is arranged such that it cooperates with an aperture 150 in the disc 100 when it is in a parked or paused position, i.e. when the segment 202 is engaged with a receptacle 122.

The sensor thus has time to detect an empty pocket 131 and signal the controller to order the rotation of the driving gear 200 to be stopped before the disc 100 is caused to rotate.

The disc 100 can thus be locked in position with an empty pocket 131 aligned with an entry portal 506 until it has safely received a coin. Once the pocket contains a coin, the driving gear 200 and consequently the disc 100 may be caused to rotate once more on instruction from the controller, until the next empty pocket 131 is detected and so on.

The walls 504 of the casing 500 define the entry portal 506 and an exit portal 507. The entry portal 506 communicates with a coin detector (not shown) which will release a coin through the entry portal 506 upon instruction from the controller provided that an empty pocket 131 of the disc 100 is aligned with the portal 506.

Once a transaction is completed the pocketed disc 100 is rotated such that it releases the coins through exit portal 507. In order to ensure the exit portal does not become jammed a second sensor (not shown) is located in the portal to detect the passing of a coin and will only allow the disc 100 to advance once the coin is clear of the exit portal 507. Said second sensor is substantially the same as the first sensor hereinbefore described. The second casing section 500 is provided with a light scattering surface 508 such that light is not returned to the sensor when the portal 507 is clear.

When the portal is clear, the second sensor indicates this to the controller which may cause the disc 100 to be advanced.

The portal 507 communicates with two exit paths 509, 510, one of which is blocked at any one time by a gate 400. Said gate 400 is mounted to the first casing section 300 by two barrelled hinges 401 and moved to block one of the exit paths and direct the coin through the other exit path as commanded by the controller.

In this way coins can either be collected via the first exit path 509 or returned via the second exit path 510 and the correct money retained by a device incorporating the coin handling mechanism of the present invention.

The exit portal may be provided with a closure flap associated with a detector (not shown) which indicates whether or not the exit portal flap is in the open or closed position. This is to reduce the risk of fraud in the event that a user forces the flap into the open position in which the mechanism may fraudulently return coins or tokens to the user.

FIG. 8 shows an alternative embodiment in which the base 110 is driven by means of a worm 600 and gear 601. The worm is driven by a motor 602 to rotate the gear 601, which in turn meshes with internal teeth 603 on the base 110. By utilizing an electronic breaking circuit the components can be stopped absolutely dead, in any desired position.

The coin handling apparatus as hereinbefore described may have far fewer components and be of a simpler construction than those previously known in the art, while at the same time having a more controllable operation. As a consequence the coin handling apparatus of the present invention may also be more economical and easier to manufacture and maintain while still complying with all the other requirements of an apparatus suitable for employment in an escrow device, and equipment utilizing such a device.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extend to any novel one, or any novel combination, of the features disclosed in this specification (including any accompanying claims, abstract and drawings), or to any novel one, or any novel combination, of the steps of any method or process so disclosed.

The invention claimed is:

1. A coin handling apparatus comprising a pocketed disc (100) arranged to cooperate with an entry portal (506) for receiving coins and an exit portal (507) for dispensing coins, and drive means arranged to cause rotation of the pocketed disc (100), said drive means comprising a driving gear (200) and a driven gear (120) wherein the pocketed disc (100) comprises said driven gear (120), and the driving gear (200) is arranged such that it rotates the disc (100) in predetermined increments and the drive means being operable to pause rotation of the pocketed disc (100) between each incremental rotation, wherein the pocketed disc (100) comprises a base (110) having the driven gear (120) formed on a first side thereof and a plurality of pockets (131) formed on the second side thereof and which have openings orientated towards the edge of said base (110).

2. A coin handling apparatus according to claim 1, wherein the drive means comprises a worm and gear drive mechanism.

3. A coin handling apparatus according to claim 2, wherein an electronic breaking circuit is employed such that the components can be stopped absolutely dead, in any desired position.

4. A coin handling apparatus according to claim 1, wherein the drive means comprises an internal geneva mechanism.

5. A coin handling apparatus according to claim 1, wherein the driving gear (200) comprises a pin which acts as a driving element (201) and a segment, removed from the pin, which acts as a parking element (202).

6. A coin handling apparatus according to claim 1, wherein the driven gear (120) comprises radially extending slots whose internal faces act as drive receiving elements (121) and arcuate cavities interposed between the slots which act as parking element receptacles (122).

7. A coin handling apparatus according to claim 1, wherein the driving gear (200) and driven gear (120) are orientated to rotate in the same plane.

8. A coin handling apparatus according to claim 1, the apparatus being provided with an anti-jam mechanism.

9. A coin handling apparatus according to claim 1, wherein the pockets (131) are formed by a wall (130) extending substantially at right angles to the base (110) and comprise open pockets (131), having no additional wall orientated parallel to the plane of the base (110) to form a side to the pockets opposed to the base (110) of the disc (100).

10. A coin handling apparatus according to claim 9, wherein the apparatus further comprises a casing (300, 500) and an internal face of the casing (500) is arranged, in use, to abut the free edges of the pocket walls (131) and thus form the side of the pockets (131) opposed to the base (110) of the disc (100).

11. A coin handling apparatus according to claim 10, wherein the walls (130) of the pocket (131) have ridged upper edges (132) arranged such that they form a number of radially extending annular ridges and grooves, which are arranged, in use, to cooperate with corresponding annular ridges and grooves (501, 502) formed upon the internal face of the casing (500) of the coin handling apparatus.

12. A coin handling apparatus according to claim 1, wherein the pocketed disc (100) is pivoted about its centre and arranged for rotation.

13. A coin handling apparatus according to claim 1, wherein a sensor is arranged adjacent the entry portal (506) to detect the presence of an empty pocket (131) adjacent to, and in line with, the portal (506) and provide a signal to indicate that the rotation of the pocketed disc (100) should be stopped.

14. A coin handling apparatus according to claim 13, wherein the base (110) of the pocketed disc (100) comprises an aperture (140) within each pocket (131) arranged to cooperate with a transmitter and receiver of the sensor, while the pocketed disc (100) is stationary such that the sensor can check to see if the pocket (131) is empty.

15. A coin handling apparatus according to claim 1, wherein the exit portal (507) is provided with a flap associated with a detector arranged to determine the position of the flap to prevent the coin handling apparatus returning coins to a user if the user forces the flap into a position which would cause coins to be returned to them.

16. A coin handling apparatus comprising a pocketed disc (100) arranged to cooperate with an entry portal (506) for receiving coins and an exit portal (507) for dispensing coins, and an energy optimiser arranged to track how many coins or tokens are in the pockets (131) of the disc (100) and then rotate the disc in the most energy efficient direction to empty the pockets (131).

17. A coin handling apparatus comprising a pocketed disc (100) arranged to cooperate with an entry portal (506) for receiving coins and an exit portal (507) for dispensing coins, and drive means arranged to cause rotation of the pocketed disc (100), said drive means comprising a driving gear (200) and a driven gear (120) wherein the pocketed disc (100) comprises said driven gear (120), and the driving gear (200) is arranged such that it rotates the disc (100) in predetermined increments and the drive means being operable to pause rotation of the pocketed disc (100) between each incremental rotation, the apparatus incorporating an energy optimiser arranged to track how many coins or tokens are in the pockets (131) of the disc (100) and then rotate the disc in the most energy efficient direction to empty the pockets (131).

18. A coin handling apparatus according to claim 17, wherein the pocketed disc (100) is pivoted about its centre and arranged for rotation.

19. A coin handling apparatus according to claim 17, wherein a sensor is arranged adjacent the entry portal (506) to detect the presence of an empty pocket (131) adjacent to, and in line with, the portal (506) and provide a signal to indicate that the rotation of the pocketed disc (100) should be stopped.

20. A coin handling apparatus according to claim 19, wherein the base (110) of the pocketed disc (100) comprises an aperture (140) within each pocket (131) arranged to cooperate with a transmitter and receiver of the sensor, while the pocketed disc (100) is stationary such that the sensor can check to see if the pocket (131) is empty.

21. A coin handling apparatus according to claim 17, wherein the exit portal (507) is provided with a flap associated with a detector arranged to determine the position of the flap to prevent the coin handling apparatus returning coins to a user if the user forces the flap into a position which would cause coins to be returned to them.

22. A coin handling apparatus according to claim 17, wherein the drive means comprises a worm and gear drive mechanism.

* * * * *